United States Patent [19]

Tullos et al.

[11] 4,258,802

[45] Mar. 31, 1981

[54] DOWNHOLE DRILLING SYSTEM

[76] Inventors: Homan C. Tullos, 100 Meadow La., Lafayette, La. 70502; Dewey W. Woods, Rte. 6, Box 194, Livingston, Tex. 77351

[21] Appl. No.: 9,149

[22] Filed: Feb. 5, 1979

[51] Int. Cl.[3] ..... E21B 4/00

[52] U.S. Cl. ..... 175/103; 175/104; 175/45

[58] Field of Search ..... 175/103, 104, 195, 40, 175/45, 50, 107, 220, 173, 92, 106; 64/23.5, 23.6, 23.7; 340/18 LD, 8; 174/47

[56] References Cited

U.S. PATENT DOCUMENTS

| | | | |
|---|---|---|---|
| 945,209 | 1/1910 | Avery | 175/107 X |
| 1,666,461 | 4/1928 | Lord | 175/103 X |
| 2,094,813 | 10/1937 | Penick et al. | 64/23.6 |
| 2,105,091 | 1/1938 | Mackay | 175/103 X |
| 2,312,804 | 3/1943 | Dernck | 64/23.6 |
| 2,670,929 | 3/1954 | Vock | 64/23.6 |
| 3,110,350 | 11/1963 | Spiri | 175/195 X |
| 3,838,953 | 10/1974 | Peterson | 175/107 X |

*Primary Examiner*—James A. Leppink
*Assistant Examiner*—Richard E. Favreau
*Attorney, Agent, or Firm*—LeBlanc, Nolan, Shur & Nies

[57] ABSTRACT

A downhole drilling system utilizes a non-rotating kelly bushing for locking in the torque created in the drill string by the downhole drilling motor. The kelly bushing prevents rotational movement of the kelly secured to the drill string on which the downhole motor is attached. The kelly bushing includes a torque mechanism for enabling the kelly and the attached drill string to move in a forward direction into the hole being drilled while prohibiting any rotational movement. A guide mechanism is provided in the kelly bushing for enabling an electrical wire to be attached to either the downhole motor or a sensing mechanism located in the area of the downhole motor for feeding back to the surface appropriate electrical signals indicative of certain drilling operations.

16 Claims, 14 Drawing Figures

FIG. 1
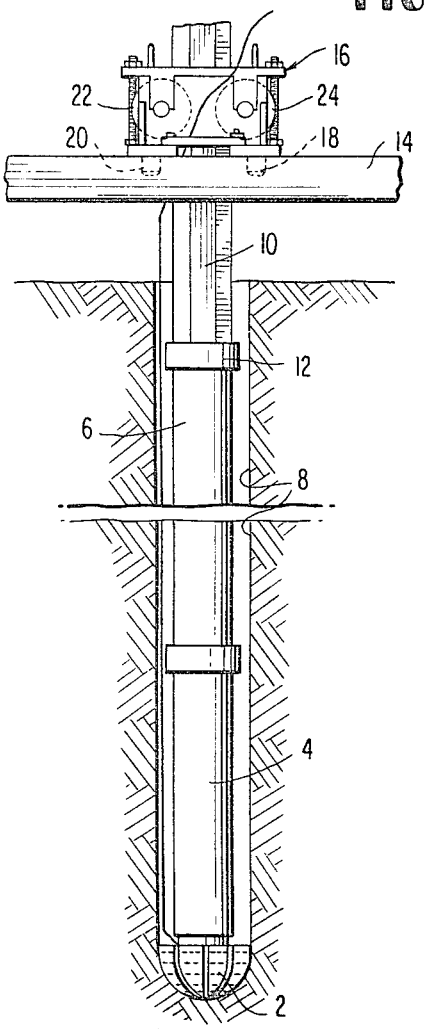
FIG. 2
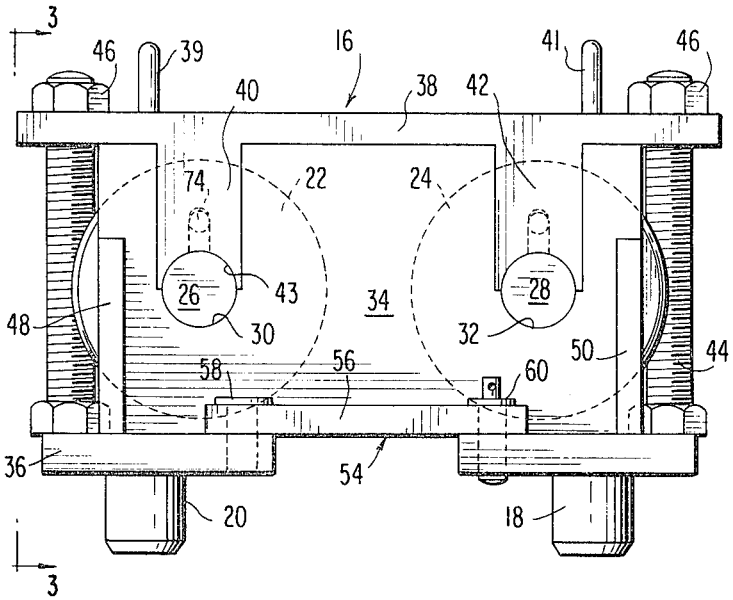
FIG. 3
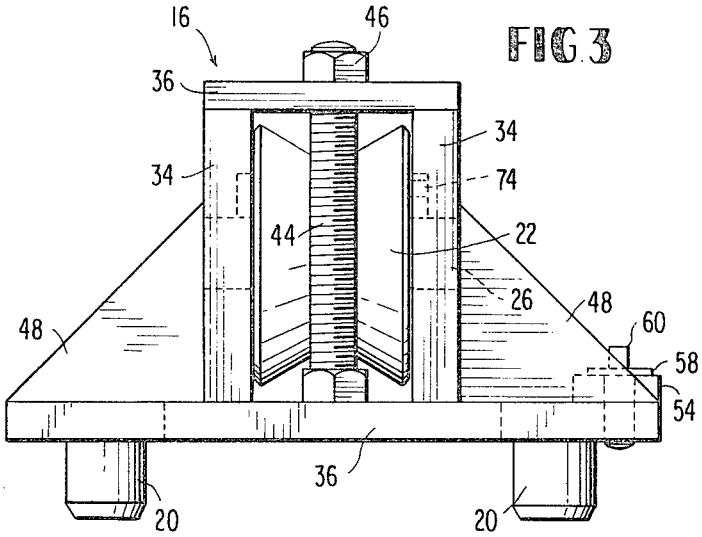
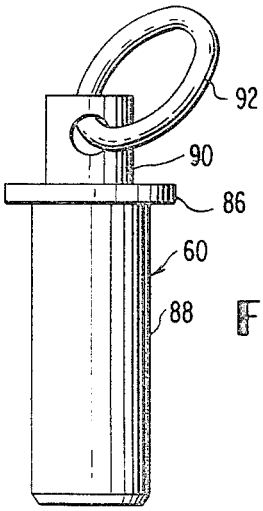
FIG. 14
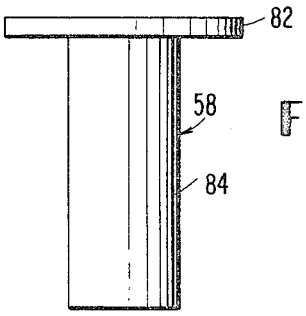
FIG. 13

FIG. 6
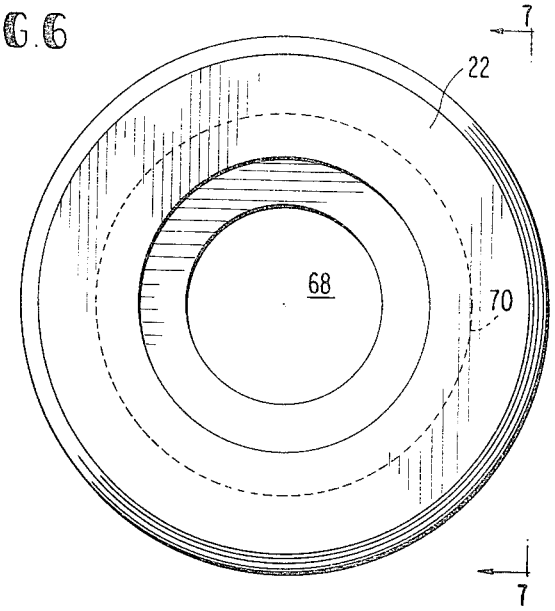
FIG. 7
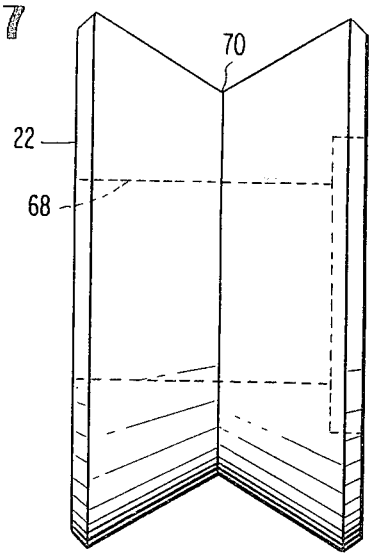
FIG. 8
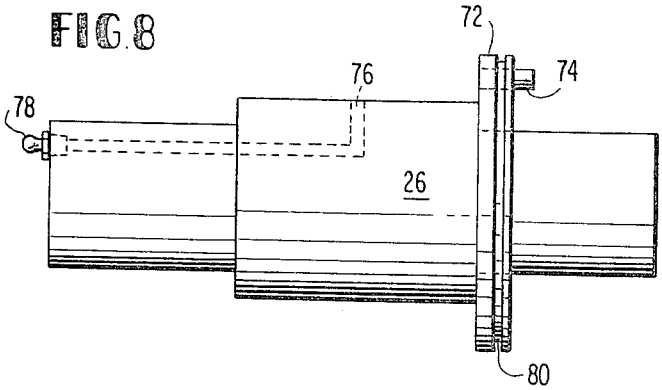
FIG. 9
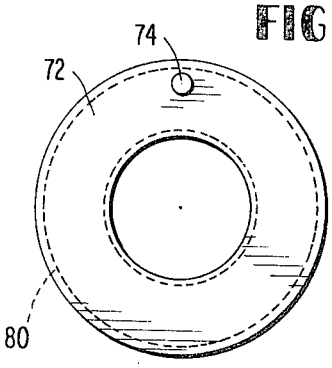
FIG. 10
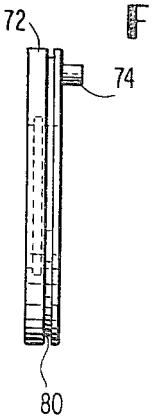
FIG. 11
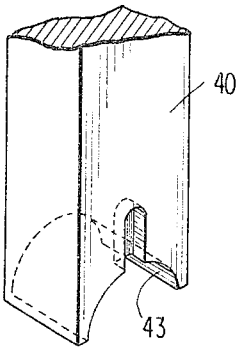
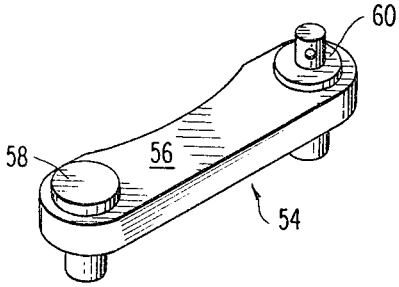
FIG. 12

DOWNHOLE DRILLING SYSTEM

BACKGROUND OF THE INVENTION

The present invention relates to downhole drilling systems.

In general, there are two approaches for carrying out the rotation of the drill during a drilling operation. Either the entire drill string on which the drilling bit is mounted can be rotated by a rotary mechanism from the surface, e.g. by a rotary table, or alternatively, the rotation of the drill bit can be carried out by a downhole motor. Typically, when rotating the pipe sections, a drilling fluid is pumped down through the drill pipe to help flush out the rock cuttings. The drilling fluid is then returned up the space between the drill string and the side of the hole being drilled. In general, the drilling fluid is a mud mixture which also serves to cool and lubricate the drill bit as the cuttings are removed. In order to enable the drill string with the attached bit to be rotated, mounted at the upper end of the drill string is a kelly. While the kelly engages the cylindrical drill pipe of the drill string, its external surface is non-cylindrical, typically hexagonal. The kelly then passes through an opening in the rotary table which has a corresponding shape as the external circumferential surface of the kelly. Thus the rotary table engages the kelly and by spinning the table, the kelly and correspondingly the drill string and the drill bit are rotated. As the drill string advances forward in the earth, the drilling operation needs to be periodically stopped so as to add an additional pipe section. When employing a rotary table along with the hose assembly for supplying the drilling fluid, this procedure for adding an additional pipe section becomes a complex and a time consuming operation.

Under certain circumstances, it becomes desirable to utilize a downhole drilling motor in place of the rotary table. The deeper the hole, the further the drilling bit from the rotary table that supplies the power from the earth's surface. Thus, there is a great energy loss between the power source and the drilling bit. In such a situation, it is preferable to place the power source as close to the drilling bit as possible, thus, it becomes beneficial to employ a downhole motor. While the motor rotates the bit, a major factor in accomplishing the forward advance of the drilling bit is the weight applied by the drill string. Thus, the downhole drilling system must be capable of transmitting radial forces which are at an angle to the longitudinal axis of the drill string and longitudinal forces which are generally parallel to the longitudinal axis of the drill string. One exemplary embodiment of such a downhole drilling system is illustrated and described in U.S. Pat. No. 3,730,284 to Striegler. Other embodiments of downhole drilling systems employing various kelly bushings, are illustrated and described in U.S. Pat. Nos. 3,842,619 to Bychurch; 3,854,539 to Sweeney; and 3,913,352 to Oliver.

During many points of the drilling operation, it is desirable to place some type of sensing equipment in the area of the downhole motor for feeding back to the surface various information concerning both the drilling operation and the characteristics of the hole being drilled. When employing such sensing equipment, an electric line from the surface must be connected to the sensing equipment. Prior to the present invention, when utilizing such sensing equipment, it has been necessary to employ a conventional type drilling system of a rotary table along with the necessary hoses for supplying the drilling fluid. With previously known arrangements for downhole drilling, there has not been any capability of feeding an electric line into the hole to the sensing equipment. Thus, it has not been possible to fully exploit the advantages of a downhole drilling system in all situations because of such limitations. By requiring the use of the rotary table and hoses for the drilling fluid whenever a sensing mechanism is to be employed, due to the extra time involved in adding additional pipe sections to the drill string, the complexity of the drilling operation and time involved is significantly increased.

SUMMARY OF THE INVENTION

An object of the present invention is to provide a downhole drilling system capable of being employed with an electrical measuring mechanism for measuring certain drilling operations and characteristics of the drilled hole during the drilling operation.

Another object of the present invention is to provide a kelly bushing capable of being used in a downhole drilling system so as to enable an electrical wire to be fed to a sensing mechanism located in the area of the downhole drilling motor.

A further object of the present invention is to provide a new and improved kelly bushing for enabling full exploitation of a downhole drilling system.

A still further object of the present invention is to provide a new and improved kelly bushing for improving the efficiency of a drilling operation in comparison to previously known systems as discussed above.

These objectives are accomplished by the employment of the downhole drilling system with the kelly bushing of the present invention. By employing the kelly bushing of the present invention, a downhole drilling system can be employed in place of the standard circulating head, or rotary table, and hose assembly for the drilling fluid that was mandatory in previously known systems when attempting to use sensing mechanisms within the hole being drilled. Exemplary of the sensing systems that would be used in a drilling operation would be an electric eye compass for sensing the direction of forward movement of the drilling bit and other sensing equipment such as that made by Sperry Sun.

The directional downhole drilling system of the present invention includes a drill string formed by one or more drilling pipes, with additional pipes being added as the drilling bit advances into the earth, a downhole drilling motor and bit mounted on the end of the drill string in the hole, a kelly mounted on the other end of the drill string and a bushing for controlling the movement of the kelly. The kelly bushing enables the kelly to move in a forward direction into the hole while prohibiting rotational movement of the kelly thereby locking in the torque created within the drill string by the downhole motor. The kelly bushing includes a support mechanism, which allows such forward movement while prohibiting rotational movement, and a guide mechanism which enables an electrical wire to be fed into the hole to a sensing mechanism located within the hole without interfering with the passage of the kelly, which is mounted at the top of the drill string, through the support mechanism. Throughout the specification and the claims herein, whenever reference is made to a drill string, that term is intended to refer to both one or more drilling pipes and the attached kelly that collectively form the drill string.

The support mechanism which controls the movement of the kelly and hence the entire drill string includes a pair of V-shaped rollers for a hexagonal shaped kelly or round rollers for a square shaped kelly. Each roller is rotatably mounted within a respective bearing support, and is located within such bearing support during the operation of the drilling equipment. The kelly has a non-cylindrical circumferential shape, typically hexagonal, and passes between the two rollers such that it fits within the V-shaped grooves which prevent rotational movement of the kelly and hence the drill string. In the event that the kelly is square shaped, it passes between the two round rollers in such a fashion that the square kelly fits within the round rollers which bear on opposite sides of the kelly and prevent rotational movement of the kelly and hence of the entire drill string. The support mechanism, however, guides the kelly through the rotational movement of the rollers in a forward direction as the drill string advances into the hole being drilled.

The support mechanism also has a base member on which the bearing supports are mounted and within that base member, there is an opening that constitutes the opening of the guide mechanism for enabling an electrical wire to be fed into the hole. That opening can be formed in the base either by a cut-out section over which a gate member is placed during operation of the drilling equipment or by a thin slot which is merely wide enough for the wire to pass through the slot. In either embodiment, the electrical wire can be fed through the base member to a position under the rollers thereby not interfering with the passage of the kelly through the support mechanism.

BRIEF DESCRIPTION OF THE DRAWINGS

FIG. 1 is a perspective view of a downhole drilling system according to the present invention.

FIG. 2 is a front elevational view of a kelly bushing in accordance with the present invention.

FIG. 3 is a side elevational view of the kelly bushing according to the present invention taken along lines 3—3 of FIG. 2.

FIG. 6 is a side elevational view of one of the rollers in the kelly bushing illustrated in FIG. 2.

FIG. 7 is a side elevational view of the roller shown in FIG. 6 taken along lines 7—7.

FIG. 8 is a side elevational view of a shaft for supporting the roller illustrated in FIG. 6.

FIG. 9 is an elevational view of the face of the shaft plate of the roller shaft illustrated in FIG. 8.

FIG. 10 is a side elevational view of the shaft plate illustrated in FIG. 9.

FIG. 11 is a perspective view of a top portion of the bearing for securing the roller and roller shaft in place during operation.

FIG. 12 is a perspective view of a hinged gate as used in the kelly bushing illustrated in FIG. 4.

FIG. 13 is a side elevational view of the hinged pin used in the hinged gate illustrated in FIG. 12.

FIG. 14 is a side elevational view of a retaining pin used with the hinged gate illustrated in FIG. 12.

DESCRIPTION OF THE PREFERRED EMBODIMENTS

Figure 4:
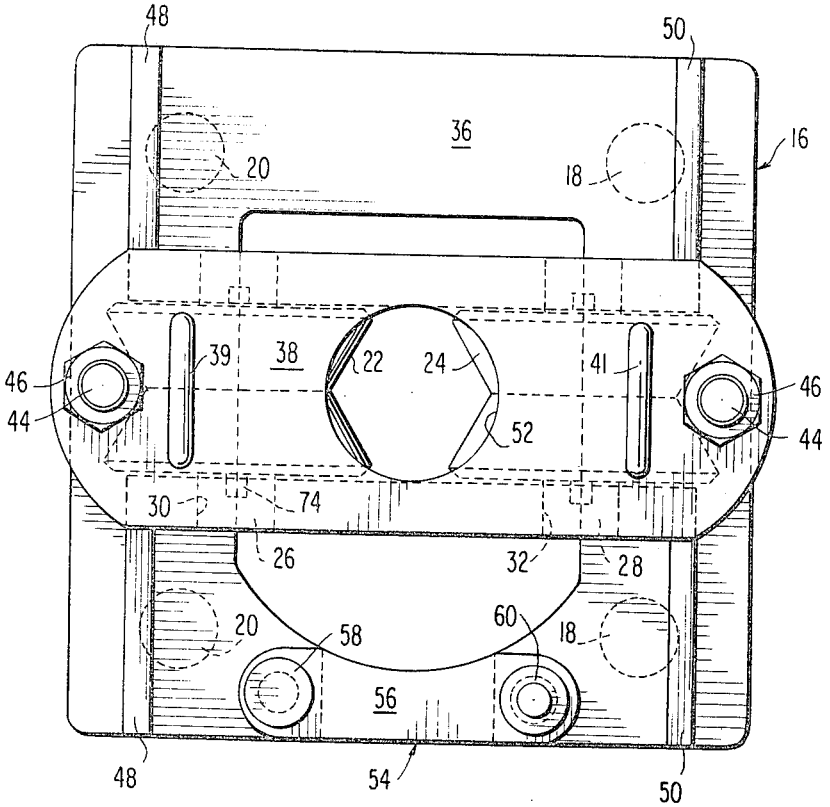
FIG. 4 is a top plan view of the kelly bushing illustrated in FIG. 2.

A directional drilling system according to the present invention is illustrated in FIG. 1. The drilling operation is carried out by a downhole motor and drill bit collectively labeled by the numeral 2, that is attached to the end of a drill string formed by plurality of drill pipes, such as pipes 4 and 6, and kelly 10 that is attached to the upper portion of the drill pipes by a coupling 12. As illustrated, the drilling system serves to drill a hole 8. As the downhole motor and drilling bit 2 move in a forward direction so as to increase the depths of hole 8, additional drilling pipes are connected between the kelly and the uppermost drilling pipe thereby increasing the length of the drill string. Kelly 10 passes through an opening in rotary table 14 and through kelly bushing 16, which serves to control the movement of kelly. The kelly bushing enables the kelly to move in a forward direction while prohibiting rotational movement of the kelly and hence locks in the torque created within the drill string by the rotation of downhole motor 2. Kelly bushing 16 is mounted on rotary table 14 by a plurality of mounting legs such as legs 18 and 20 which are secured within corresponding openings in the rotary table 14. Rotary table 14 is secured against rotation during normal operations.

Kelly bushing 16 includes a pair of rollers 22 and 24, such as illustrated in FIG. 2. Each of the rollers, respectively, is mounted on a rotatable shaft 26 and 28. These shafts in turn are secured within bearings 30 and 32. The bottom portion of bearings 30 and 32 are formed within front and back plates 34. The top portions of the bearings are formed by the extended portions 40 and 42 from top plate 38.

All the elements of the kelly bushing are mounted on and secured to base plate 36 such as shown in FIG. 2. After the rollers have been set in place in the lower portions of the bearings in front and back plates 34, top plate 38 is placed over the rollers so as to secure the rollers in place within the kelly bushing. Top plate 38 is secured to base member 36 by a pair of nuts and bolts, such as bolt 44 and nut 46. Once the top plate is locked into place, the entire kelly bushing can be lifted by handles 39 and 41 that are secured to top plate 38.

Front and back plates 34 are provided with extra support against lateral movement by a plurality of triangular plates 48 and 50. The angular position of these triangular plates can be varied in order to vary the support against lateral movement. Once top plate 38 is securely fastened on front and back plates 34, a solid and firm support for rollers 22 and 24 for supporting and guiding the movement of the kelly is provided.

In using the kelly bushing 16 with the kelly, the kelly passes through an opening 52 in top plate 38. The kelly then passes between the two rollers 22 and 24 and out through an opening in base plate 36. The opening in the top plate is illustrated in FIG. 4.

On one side, either front or rear side, an opening is provided in base member 36. That opening is then covered over by a gate mechanism 54, such as illustrated in FIG. 4. The gate mechanism includes a gate member 56 which is secured to base member 36 by hinge pin 58. The other end of the gate member is also attached to base member 36 but by a retaining pin 60 that can be removed whenever gate member 56 is to be opened. Whenever an electrical wire is to be inserted down into the hole, retaining pin 60 is removed, gate member 56 is opened thereby presenting an opening in base member 36 and the electrical wire is then fed through such opening in the base member to a position below the support rollers for the kelly and down into the hole. After the wire has been put into place, gate member 56 is closed and retaining pin 60 is reinserted. Thus during operation of the drilling system the electrical wire is held in place within the kelly bushing.

Figure 5:
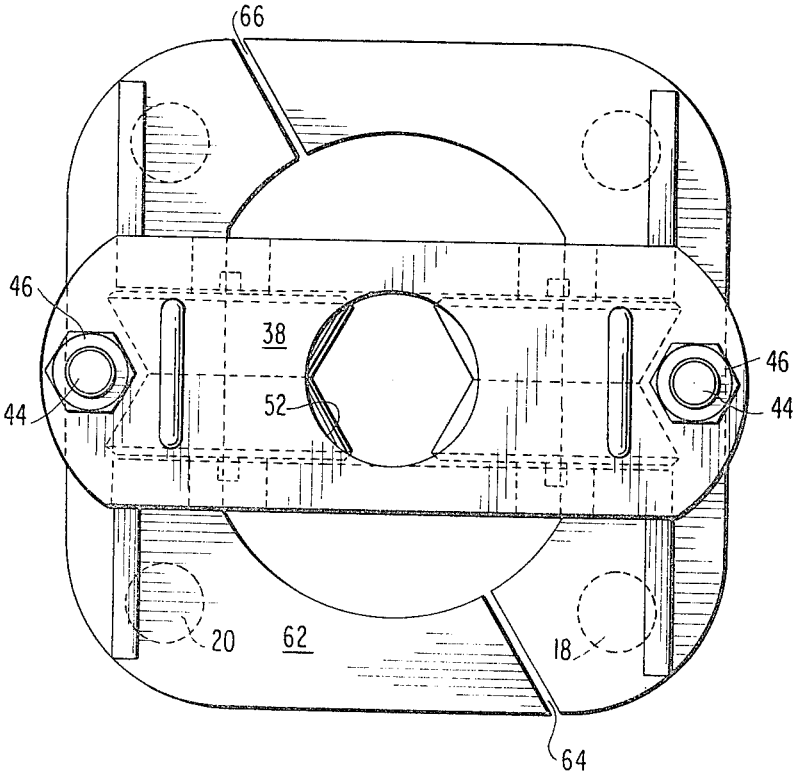
FIG. 5 is a top plan view of a modified embodiment of the kelly bushing according to the present invention.

In accordance with a modified embodiment of the present invention, in place of gate mechanism 54, a modified base member 62 having a plurality of slots therein can be used, such as shown in FIG. 5. Base member 62 is shown with two slots, 64 and 66, which allow for passage of the electrical wire through the slot so that the wire can be fed to a position below the support rollers. Each of the slots, 64 and 66, such as shown in FIG. 5 can be covered by a latch.

Each of the rollers for controlling the movement of the kelly, such as roller 22, has an opening 68 through its center such as shown in FIG. 6. Each of the rollers is approximately V-shaped such as shown by the V-shaped configuration 70 in FIG. 7. The V-shaped configuration allows the roller to firmly engage the kelly which has a non-cylindrical configuration typically a hexagonal configuration. Since the kelly fits within V-shaped groove, the kelly and hence the entire drill string is locked against rotational movement. The kelly may be square in shape in which case each of the rollers is round instead of V-shaped. The round shaped configuration of the rollers allows the rollers to firmly engage the square shaped kelly by fitting firmly against opposite sides of the kelly. Since the kelly fits within the rollers bearing against it from opposite sides, the kelly and hence the entire drill string is locked against rotational movement.

The roller is mounted on an appropriate roller shaft as shown in FIG. 8. Shaft 26 has a retaining plate 72 which secures the roller on the shaft and is locked against rotational movement by a pin 74 which can engage or be mounted within a recess in leg 40 above bearing surface 43 (see FIGS. 2 and 11). Additional views of this retaining plate are shown in FIGS. 9 and 10. The plate has a grease groove 80 which can be filled with an appropriate lubricant. A grease fitting 78 also is provided within shaft 26 which allows grease to be fed through an opening to a grease hole 76 for lubricating the roller itself. It should be kept in mind in this regard that the rollers are only being rotated due to the movement of the kelly and are not actually being driven. Hence, it is only necessary for the rollers to be able to freely rotate for enabling forward movement of the kelly and hence the drill string while preventing the rotational movement of the kelly and the drill string. After shaft 26 with roller 22 has been placed in the bearings in front and rear plates 34 of the kelly bushing, top plate 38 which carries the top portions of the bearings, such as portion 40 as illustrated in FIG. 11, is mounted in place. Bearing 40 has a bearing surface 43 which actually engages this shaft and locks it into place.

Additional illustrations of gate mechanism 54 and portions thereof are shown in FIGS. 12, 13 and 14. As shown in FIG. 13, hinged pin 58 has a shaft portion 84 and top disc 82. Retaining pin 60 has a shaft portion 88, a top plate 86 and a top protuberance 90. Protuberance 90 has an opening therein through which a chain 92 passes. Chain 92 is used for enabling one to remove retaining pin 60 whenever the gate is to be opened.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

We claim:

1. A kelly bushing for use with a drill string during a downhole drilling operation where a downhole drilling motor is mounted on the end of the drill string in the hole being drilled and the drill string has a kelly mounted on its upper end, said bushing comprising:

a base member having an aperture through which the kelly can pass;

support means mounted on said base member, said support means enabling the kelly to move in a forward direction into the hole while preventing movement of the kelly in a direction transverse to such forward direction, said support means including locking means for preventing rotation of the drill string so as to lock in the torque created in the drill string by the downhole motor;

and guide means including an opening in said base member and extending from the outer edge of said base member to said aperture in said base member, said opening in said base member enabling an electrical wire to be fed into the hole for connection to an electrical device mounted in the location of the end of the drill string progressing into the hole with such wire being fed without interfering with the passage of the kelly through said support means.

2. A kelly bushing according to claim 1 wherein said support means includes a pair of rollers, each of said rollers being arranged in engagement with the kelly mounted on the end of the drill string opposite the location of the downhole motor, said rollers serving to guide the kelly and the drill string as the downhole motor advances into the hole, said rollers being appropriately configured so that when said rollers engage the kelly, they prohibit rotational movement of the kelly and the drill string thereby locking in the torque generated by the downhole motor.

3. A kelly bushing according to claim 2 wherein said guide means enables the electrical wire to be fed from under said rollers and along the drill string to a measuring device located on a lower portion of the drill string.

4. A kelly bushing according to claim 2 wherein said guide means enables the electrical wire to be fed from under said rollers and along the drill string to be connected to the downhole motor.

5. A kelly bushing according to claim 2 wherein said support means and said guide means are constructed so as to facilitate the connection of additional pipe to the drill string without necessitating the dismantling of said kelly bushing.

6. A kelly bushing according to claim 5 wherein said support means includes bearing support members for supporting said rollers in such a manner to enable said rollers to be rotatable and means for securing said rollers in said bearing support members.

7. A kelly bushing according to claim 6 wherein said guide means includes a hinged gate member pivotable between an opened and closed position and serving to close said opening in said base member during operation of the downhole motor for securing the electrical wire within said kelly bushing.

8. A kelly bushing according to claim 6 wherein said opening in said base member is formed by a slot in said base member.

9. A directional drilling system comprising:

a drill string having a kelly mounted on its upper end;

a downhole motor drilling means mounted on the end of said drill string in the hole being drilled;

and, a kelly bushing including:

a base member having an aperture through which said kelly can pass;

support means mounted on said base member, said support means enabling said kelly to move in a forward direction into the hole while preventing movement of said kelly in a direction transverse to such forward direction, said support means including locking means for preventing rotation of said drill string so as to lock in the torque created in said drill string by said downhole motor drilling means;

and, guide means including an opening in said base member and extending from the outer edge of said base member to said aperture in said base member, said opening in said base member enabling an electrical wire to be fed into the hole for connection to an electrical member mounted in the location of the end of said drill string progressing into the hole with such wire being fed without interfering with the passage of said kelly through said support means.

10. A system according to claim 9 wherein said support means includes a pair of rollers, each of said rollers being arranged in engagement with said kelly mounted on the end of said drill string opposite the location of said downhole motor drilling means, said rollers serving to guide said kelly and said drill string as said downhole motor drilling means advances into the hole, said rollers being appropriately configured so that when said rollers engage said kelly, they prohibit rotational movement of said kelly and said drill string thereby locking in the torque generated by said downhole motor drilling means.

11. A system according to claim 10 wherein said guide means enables the electrical wire to be fed from under said rollers and along said drill string to a measuring device located on a lower portion of the drill string.

12. A system according to claim 10 wherein said guide means enables the electrical wire to be fed from under said rollers and along the drill string to be connected to said downhole motor drilling means.

13. A system according to claim 10 wherein said support means and said guide means are constructed so as to facilitate the connection of additional pipe to said drill string without necessitating the dismantling of said kelly bushing.

14. A system according to claim 13 wherein said support means includes bearing support members for supporting said rollers in such a manner to enable said rollers to be rotatable and means for securing said rollers in said bearing support members.

15. A system according to claim 14 wherein said guide means includes a hinged gate member pivotable between an opened and closed position and serving to close said opening in said base member during operation of said downhole motor drilling means for securing the electrical wire within said kelly bushing.

16. A system according to claim 14 wherein said opening in said base member is formed by a slot in said base member.

* * * * *